US008757278B2

(12) United States Patent
Smithson

(10) Patent No.: US 8,757,278 B2
(45) Date of Patent: Jun. 24, 2014

(54) SNEAK PATH ELIMINATOR FOR DIODE MULTIPLEXED CONTROL OF DOWNHOLE WELL TOOLS

(75) Inventor: Mitchell C. Smithson, Pasadena, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 698 days.

(21) Appl. No.: 12/792,298

(22) Filed: Jun. 2, 2010

(65) Prior Publication Data

US 2010/0237698 A1 Sep. 23, 2010

Related U.S. Application Data

(63) Continuation-in-part of application No. PCT/US2008/075668, filed on Sep. 9, 2008.

(51) Int. Cl.
*E21B 23/00* (2006.01)

(52) U.S. Cl.
USPC ..... 166/381; 166/65.1; 166/373; 166/316

(58) Field of Classification Search
USPC ..... 166/381, 373, 651, 316
See application file for complete search history.

(56) References Cited

U.S. PATENT DOCUMENTS 3,327,791 A * 6/1967 Harrigan, Jr. ..... 175/4.55
3,427,580 A 2/1969 Brock
3,430,712 A 3/1969 Stafford
3,565,189 A 2/1971 Herbert
3,575,650 A 4/1971 Fengler
3,717,095 A 2/1973 Vann
3,906,328 A 9/1975 Wenrich et al.
4,138,669 A 2/1979 Edison et al.
4,279,304 A 7/1981 Harper (Continued)

FOREIGN PATENT DOCUMENTS

WO 2004012040 A2 2/2004
WO 2004081335 A2 9/2004

(Continued)

OTHER PUBLICATIONS

International Search Report and Written Opinion issued May 26, 2009, for International Application Serial No. PCT/US08/075668, 11 pages.

(Continued)

*Primary Examiner* — Jennifer H Gay
*Assistant Examiner* — Elizabeth Gitlin
(74) *Attorney, Agent, or Firm* — Smith IP Services, P.C.

(57) ABSTRACT

Sneak path elimination in diode multiplexed control of downhole well tools. A system for selectively actuating multiple well tools includes a control device for each tool, a well tool being operable by selecting a respective control device; conductors connected to the control devices, which are selectable by applying a predetermined voltage across a respective predetermined pair of the conductors; and at least one lockout device for each control device, the lockout devices preventing current from flowing through the respective control devices when voltage across the respective predetermined pair of the conductors is less than a predetermined minimum. A method includes selecting a well tools for actuation by applying a predetermined minimum voltage to a set of conductors; and preventing actuation of another well tool when the predetermined minimum voltage is not applied across another set of conductors, at least one conductor being common to the two sets of conductors.

15 Claims, 10 Drawing Sheets

(56) References Cited

U.S. PATENT DOCUMENTS

| | | | | |
|---|---|---|---|---|
| 4,303,128 | A | 12/1981 | Marr, Jr. | |
| 4,345,650 | A | 8/1982 | Wesley | |
| 4,364,587 | A | 12/1982 | Samford | |
| 4,396,062 | A | 8/1983 | Iskander | |
| 4,442,903 | A | 4/1984 | Schutt et al. | |
| 4,467,833 | A | 8/1984 | Satterwhite et al. | |
| 4,485,780 | A | 12/1984 | Price et al. | |
| 4,495,990 | A | 1/1985 | Titus et al. | |
| 4,526,667 | A | 7/1985 | Parkhurst et al. | |
| 4,527,636 | A | 7/1985 | Bordon | |
| 4,570,715 | A | 2/1986 | Van Meurs et al. | |
| 4,618,197 | A | 10/1986 | White | |
| 4,716,960 | A | 1/1988 | Eastlund et al. | |
| 4,747,451 | A | 5/1988 | Adams, Jr. et al. | |
| 4,765,184 | A | 8/1988 | Delatorre | |
| 4,911,239 | A | 3/1990 | Winckler et al. | |
| 4,919,201 | A | 4/1990 | Bridges et al. | |
| 4,921,438 | A | 5/1990 | Godfrey et al. | |
| 4,945,995 | A | 8/1990 | Tholance et al. | |
| 4,967,048 | A | 10/1990 | Langston | |
| 4,984,594 | A | 1/1991 | Vinegar et al. | |
| 5,022,485 | A * | 6/1991 | Mitchell | 181/106 |
| RE33,690 | E | 9/1991 | Adams, Jr. et al. | |
| 5,058,683 | A | 10/1991 | Godfrey et al. | |
| 5,099,918 | A | 3/1992 | Bridges et al. | |
| 5,156,220 | A | 10/1992 | Forehand et al. | |
| 5,166,677 | A | 11/1992 | Schoenberg | |
| 5,207,273 | A | 5/1993 | Cates et al. | |
| 5,251,703 | A | 10/1993 | Skinner | |
| 5,279,363 | A | 1/1994 | Schultz et al. | |
| 5,282,508 | A | 2/1994 | Ellingsen et al. | |
| 5,332,035 | A | 7/1994 | Schultz et al. | |
| 5,343,963 | A | 9/1994 | Bouldin et al. | |
| 5,375,658 | A | 12/1994 | Schultz et al. | |
| 5,516,603 | A | 5/1996 | Holcombe | |
| 5,547,029 | A | 8/1996 | Rubbo et al. | |
| 5,839,508 | A | 11/1998 | Tubel et al. | |
| 5,868,201 | A | 2/1999 | Bussear et al. | |
| 5,896,076 | A | 4/1999 | Van Namen | |
| 6,032,733 | A | 3/2000 | Ludwig et al. | |
| 6,164,375 | A | 12/2000 | Carisella | |
| 6,176,308 | B1 | 1/2001 | Pearson | |
| 6,179,052 | B1 | 1/2001 | Purkis et al. | |
| 6,247,536 | B1 | 6/2001 | Leismer et al. | |
| 6,315,043 | B1 | 11/2001 | Farrant et al. | |
| 6,315,049 | B1 | 11/2001 | Hickey et al. | |
| 6,433,991 | B1 | 8/2002 | Deaton et al. | |
| 6,450,263 | B1 | 9/2002 | Schwendemann | |
| 6,464,011 | B2 | 10/2002 | Tubel | |
| 6,470,970 | B1 | 10/2002 | Purkis et al. | |
| 6,547,010 | B2 | 4/2003 | Hensley et al. | |
| 6,567,013 | B1 | 5/2003 | Purkis et al. | |
| 6,575,237 | B2 | 6/2003 | Purkis et al. | |
| 6,585,051 | B2 | 7/2003 | Purkis et al. | |
| 6,668,936 | B2 | 12/2003 | Williamson, Jr. et al. | |
| 6,679,332 | B2 | 1/2004 | Vinegar et al. | |
| 6,725,925 | B2 | 4/2004 | Al-Ramadhan | |
| 6,736,213 | B2 | 5/2004 | Bussear et al. | |
| 6,782,952 | B2 | 8/2004 | Garay et al. | |
| 6,796,213 | B1 | 9/2004 | McKendree et al. | |
| 6,812,811 | B2 | 11/2004 | Robison et al. | |
| 6,912,142 | B2 * | 6/2005 | Keim et al. | 363/89 |
| 6,958,704 | B2 | 10/2005 | Vinegar et al. | |
| 6,967,589 | B1 | 11/2005 | Peters | |
| 7,007,756 | B2 | 3/2006 | Lerche et al. | |
| 7,011,152 | B2 | 3/2006 | Soelvik | |
| 7,017,662 | B2 | 3/2006 | Schultz et al. | |
| 7,038,332 | B2 | 5/2006 | Robison et al. | |
| 7,040,391 | B2 | 5/2006 | Leuthen et al. | |
| 7,066,261 | B2 | 6/2006 | Vicente et al. | |
| 7,145,471 | B2 | 12/2006 | Purkis et al. | |
| 7,147,182 | B1 | 12/2006 | Flanigan | |
| 7,322,409 | B2 | 1/2008 | Wittle et al. | |
| 7,440,283 | B1 | 10/2008 | Rafie | |
| 7,468,890 | B2 | 12/2008 | Lin | |
| 7,520,321 | B2 | 4/2009 | Hiron et al. | |
| 2001/0037884 | A1 | 11/2001 | Schultz et al. | |
| 2002/0014338 | A1 | 2/2002 | Purkis et al. | |
| 2002/0050354 | A1 | 5/2002 | Schultz et al. | |
| 2003/0048197 | A1 | 3/2003 | Purkis et al. | |
| 2003/0051881 | A1 | 3/2003 | Vinegar et al. | |
| 2003/0131990 | A1 | 7/2003 | Tubel et al. | |
| 2010/0059233 | A1 | 3/2010 | Smithson | |
| 2010/0236790 | A1 | 9/2010 | Smithson | |
| 2010/0237698 | A1 | 9/2010 | Smithson | |
| 2011/0067854 | A1 | 3/2011 | Love et al. | |

FOREIGN PATENT DOCUMENTS

| | | | |
|---|---|---|---|
| WO | 2007116264 | A1 | 10/2007 |
| WO | 2010030266 | A1 | 3/2010 |
| WO | 2010030422 | A1 | 3/2010 |
| WO | 2010030423 | A1 | 3/2010 |

OTHER PUBLICATIONS

International Search Report and Written Opinion issued Jul. 27, 2009, for International Application Serial No. PCT/US09/046363, 8 pages.

International Search Report and Written Opinion issued Jul. 27, 2009, for International Application Serial No. PCT/US09/046404, 8 pages.

Canadian Office Action issued Jul. 3, 2012 for CA Patent Application No. 2735384, 4 pages.

International Search Report and Written Opinion issued May 7, 2007, for International Patent Application Serial No. PCT/US06/02304, 6 pages.

International Search Report and Written Opinion issued May 26, 2009, for International Patent Application Serial No. PCT/US08/75668, 11 pages.

Lee Flosert Constant Flow Rate Product Brochure, Dec. 2002, 1 page.

Office Action issued Jun. 24, 2009, for U.S. Appl. No. 11/626,033, 23 pages.

International Search Report and Written Opinion issued Jul. 27, 2009, for International Patent Application Serial No. PCT/US09/46363, 8 pages.

International Search Report and Written Opinion issued Jul. 27, 2009, for International Patent Application Serial No. PCT/US09/46404, 8 pages.

U.S. Appl. No. 12/390,758, filed Feb. 23, 2009, 31 pages.

Advisory Action issued May 14, 2012, for U.S. Appl. No. 12/555,451, 3 pages.

Office Action issued May 21, 2012, for U.S. Appl. No. 12/792,402, 29 pages.

International Preliminary Report on Patentability issued Mar. 24, 2011, for International Patent Application No. PCT/US09/046363, 7 pages.

International Preliminary Report on Patentability issued Mar. 24, 2011, for International Patent Application No. PCT/US08/075668, 6 pages.

Australian Examiner's Report issued Apr. 17, 2011 for AU Patent Application No. 2009292150, 2 pages.

International Preliminary report on Patentability issued Mar. 24, 2011, for International Patent Application No. PCT/US09/056339, 7 pages.

Australian Office Action issued Feb. 4, 2010, for AU Patent Application Serial No. 2006336428, 2 pages.

Canadian Office Action issued Nov. 18, 2009, for Canadian Patent Application Serial No. 2,637,326, 3 pages.

Office Action issued Dec. 17, 2009, for U.S. Appl. No. 11/626,033, 10 pages.

International Search Report and Written Opinion issued Oct. 21, 2009, for International Patent Application Serial No. PCT/US09/56339, 8 pages.

Office Action issued Oct. 5, 2011, for U.S. Appl. No. 12/555,451, 23 pages.

Office Action issued Mar. 7, 2012, for U.S. Appl. No. 12/555,451, 10 pages.

(56) References Cited

OTHER PUBLICATIONS

Office Action issued Oct. 5, 2011 for U.S. Appl. No. 12/555,451, 23 pages.
E&P Focus; "Access Technologies: Slider technology Improves Directional Drilling Efficiency", National Energy Technology Laboratory, US Department of Energy, dated Apr. 2007, 10 pages.
International Search Report and Written Opinion issued Jan. 4, 2012 for PCT Patent Application No. PCT/US2011/021899, 2 pages.
All About Circuits; "The Silicon-Controlled Rectifier", Online article, www.allaboutcircuits.com/vol_3/chpt_75.html, dated 1999-2000, 12 pages.
Kenneth Thomas, Bjorn Backlund, Orhan Toker, Bjorn Thorvaldsson; "The Bidirectional Control Thyristor", dated 1999, 10 pages.
Canadian Office Action issued Mar. 19, 2013 for Canadian Patent Application No. 2,375,384, 2 pages.
Office Action issued Jan. 24, 2013 for U.S. Appl. No. 12/792,240, 24 pages.

* cited by examiner

SNEAK PATH ELIMINATOR FOR DIODE MULTIPLEXED CONTROL OF DOWNHOLE WELL TOOLS

CROSS-REFERENCE TO RELATED APPLICATIONS

This application is a continuation-in-part of prior International Application Serial No. PCT/US08/75668, filed Sep. 9, 2008. This application also claims the benefit under 35 USC §119 of the filing date of International Application Serial No. PCT/US09/46363, filed Jun. 5, 2009. The entire disclosures of these prior applications are incorporated herein by this reference.

BACKGROUND

The present disclosure relates generally to operations performed and equipment utilized in conjunction with a subterranean well and, in an embodiment described herein, more particularly provides for sneak path elimination in diode multiplexed control of downhole well tools.

It is useful to be able to selectively actuate well tools in a subterranean well. For example, production flow from each of multiple zones of a reservoir can be individually regulated by using a remotely controllable choke for each respective zone. The chokes can be interconnected in a production tubing string so that, by varying the setting of each choke, the proportion of production flow entering the tubing string from each zone can be maintained or adjusted as desired.

Unfortunately, this concept is more complex in actual practice. In order to be able to individually actuate multiple downhole well tools, a relatively large number of wires, lines, etc. have to be installed and/or complex wireless telemetry and downhole power systems need to be utilized. Each of these scenarios involves use of relatively unreliable downhole electronics and/or the extending and sealing of many lines through bulkheads, packers, hangers, wellheads, etc.

Therefore, it will be appreciated that advancements in the art of remotely actuating downhole well tools are needed. Such advancements would preferably reduce the number of lines, wires, etc. installed, would preferably reduce or eliminate the need for downhole electronics, and would preferably prevent undesirable current draw.

SUMMARY

In carrying out the principles of the present disclosure, systems and methods are provided which advance the art of downhole well tool control. One example is described below in which a relatively large number of well tools may be selectively actuated using a relatively small number of lines, wires, etc. Another example is described below in which a direction of current flow through a set of conductors is used to select which of two respective well tools is to be actuated. Yet another example is described below in which current flow is not permitted through unintended well tool control devices.

In one aspect, a system for selectively actuating from a remote location multiple downhole well tools in a well is provided. The system includes at least one control device for each of the well tools, such that a particular one of the well tools can be actuated when a respective control device is selected. Conductors are connected to the control devices, whereby each of the control devices can be selected by applying a predetermined voltage potential across a respective predetermined pair of the conductors. At least one lockout device is provided for each of the control devices, whereby the lockout devices prevent current from flowing through the respective control devices if the voltage potential across the respective predetermined pair of the conductors is less than a predetermined minimum.

In another aspect, a method of selectively actuating from a remote location multiple downhole well tools in a well is provided. The method includes the steps of: selecting a first one of the well tools for actuation by applying a predetermined minimum voltage potential to a first set of conductors in the well; and preventing actuation of a second one of the well tools when the predetermined minimum voltage potential is not applied across a second set of conductors in the well. At least one of the first set of conductors is the same as at least one of the second set of conductors.

In yet another aspect, a system for selectively actuating from a remote location multiple downhole well tools in a well includes at least one control device for each of the well tools, such that a particular one of the well tools can be actuated when a respective control device is selected; conductors connected to the control devices, whereby each of the control devices can be selected by applying a predetermined voltage potential across a respective predetermined pair of the conductors; and at least one lockout device for each of the control devices, whereby each lockout device prevents a respective control device from being selected if the voltage potential across the respective predetermined pair of the conductors is less than a predetermined minimum.

One of the conductors may be a tubular string extending into the earth, or in effect "ground."

These and other features, advantages, benefits and objects will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the following description of the representative embodiments of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Figure 1:
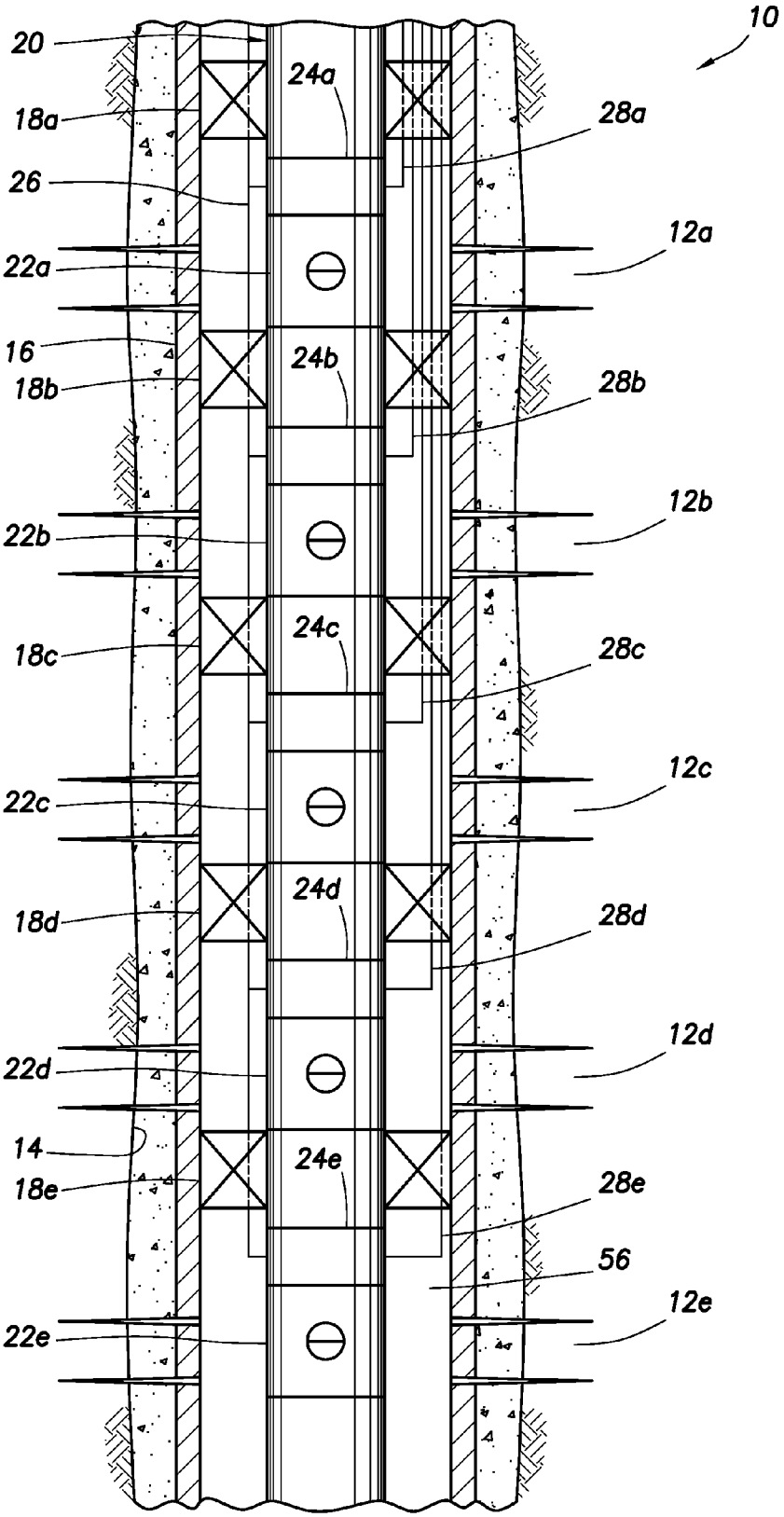
FIG. 1 (PRIOR ART)
FIG. 1 is a schematic view of a prior art well control system.

Representatively illustrated in FIG. 1 is a well control system 10 which is used to illustrate the types of problems inherent in prior art systems and methods. Although the drawing depicts prior art concepts, it is not meant to imply that any particular prior art well control system included the exact configuration illustrated in FIG. 1.

The control system 10 as depicted in FIG. 1 is used to control production flow from multiple zones 12*a-e* intersected by a wellbore 14. In this example, the wellbore 14 has been cased and cemented, and the zones 12*a-e* are isolated within a casing string 16 by packers 18*a-e* carried on a production tubing string 20.

Fluid communication between the zones 12*a-e* and the interior of the tubing string 20 is controlled by means of flow control devices 22*a-e* interconnected in the tubing string. The flow control devices 22*a-e* have respective actuators 24*a-e* for actuating the flow control devices open, closed or in a flow choking position between open and closed.

In this example, the control system 10 is hydraulically operated, and the actuators 24*a-e* are relatively simple piston-and-cylinder actuators. Each actuator 24*a-e* is connected to two hydraulic lines—a balance line 26 and a respective one of multiple control lines 28*a-e*. A pressure differential between the balance line 26 and the respective control line 28*a-e* is applied from a remote location (such as the earth's surface, a subsea wellhead, etc.) to displace the piston of the corresponding actuator 24*a-e* and thereby actuate the associated flow control device 22*a-e*, with the direction of displacement being dependent on the direction of the pressure differential.

There are many problems associated with the control system 10. One problem is that a relatively large number of lines 26, 28*a-e* are needed to control actuation of the devices 22*a-e*. These lines 26, 28*a-e* must extend through and be sealed off at the packers 18*a-e*, as well as at various bulkheads, hangers, wellhead, etc.

Another problem is that it is difficult to precisely control pressure differentials between lines extending perhaps a thousand or more meters into the earth. This can lead to improper or unwanted actuation of the devices 22*a-e*, as well as imprecise regulation of flow from the zones 12*a-e*.

Attempts have been made to solve these problems by using downhole electronic control modules for selectively actuating the devices 22*a-e*. However, these control modules include sensitive electronics which are frequently damaged by the hostile downhole environment (high temperature and pressure, etc.).

Furthermore, electrical power must be supplied to the electronics by specialized high temperature batteries, by downhole power generation or by wires which (like the lines 26, 28*a-e*) must extend through and be sealed at various places in the system. Signals to operate the control modules must be supplied via the wires or by wireless telemetry, which includes its own set of problems.

Thus, the use of downhole electronic control modules solves some problems of the control system 10, but introduces other problems. Likewise, mechanical and hydraulic solutions have been attempted, but most of these are complex, practically unworkable or failure-prone.

Figure 2:
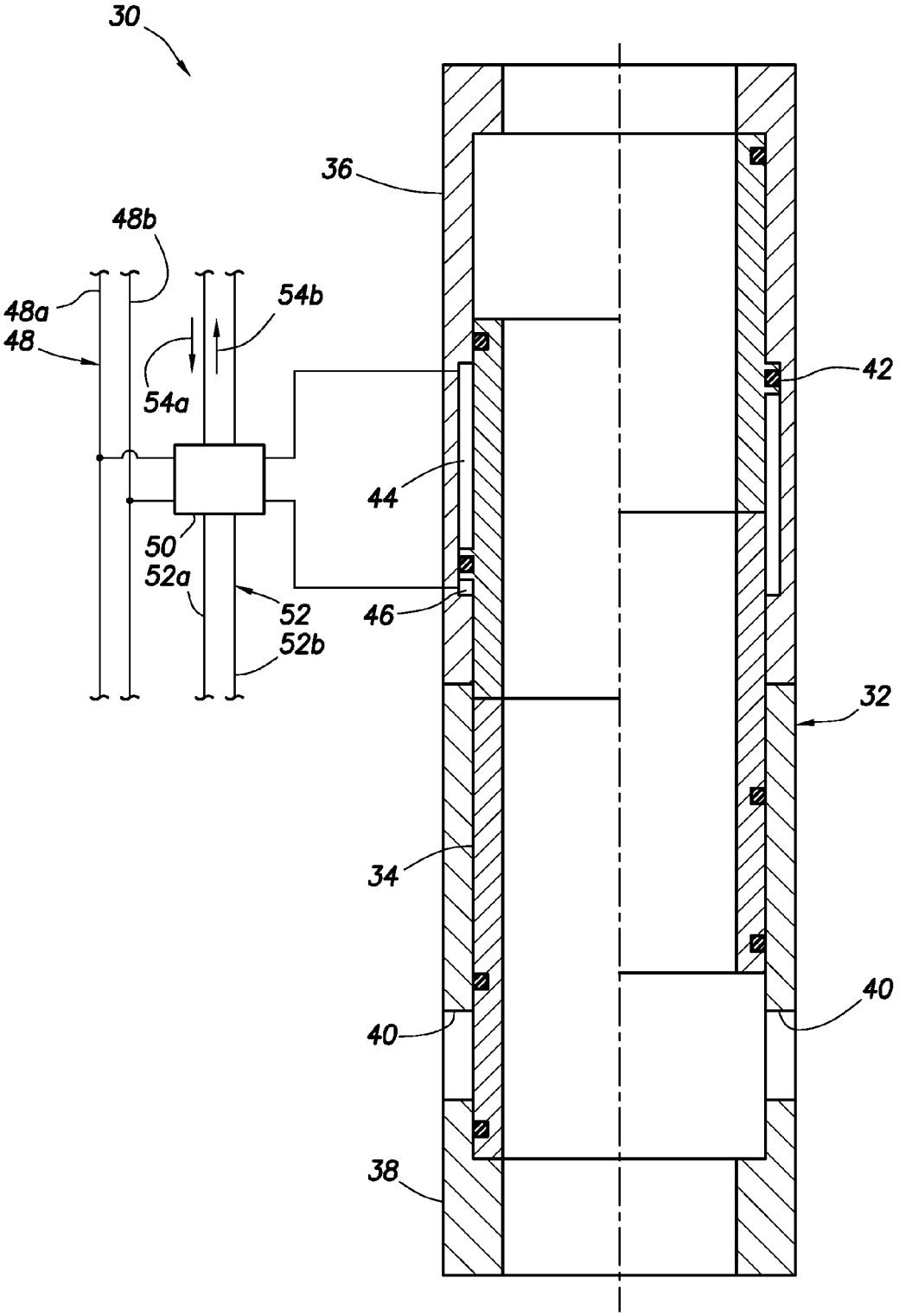
FIG. 2 is an enlarged scale schematic view of a flow control device and associated control device which embody principles of the present disclosure.

Turning now to FIG. 2, a system 30 and associated method for selectively actuating multiple well tools 32 are representatively illustrated. Only a single well tool 32 is depicted in FIG. 2 for clarity of illustration and description, but the manner in which the system 30 may be used to selectively actuate multiple well tools is described more fully below.

The well tool 32 in this example is depicted as including a flow control device 38 (such as a valve or choke), but other types or combinations of well tools may be selectively actuated using the principles of this disclosure, if desired. A sliding sleeve 34 is displaced upwardly or downwardly by an actuator 36 to open or close ports 40. The sleeve 34 can also be used to partially open the ports 40 and thereby variably restrict flow through the ports.

The actuator 36 includes an annular piston 42 which separates two chambers 44, 46. The chambers 44, 46 are connected to lines 48*a,b* via a control device 50. D.C. current flow in a set of electrical conductors 52*a,b* is used to select whether the well tool 32 is to be actuated in response to a pressure differential between the lines 48*a,b*.

In one example, the well tool 32 is selected for actuation by flowing current between the conductors 52*a,b* in a first direction 54*a* (in which case the chambers 44, 46 are connected to the lines 48*a,b*), but the well tool 32 is not selected for actuation when current flows between the conductors 52*a,b* in a second, opposite, direction 54*b* (in which case the chambers 44, 46 are isolated from the lines 48*a,b*). Various configurations of the control device 50 are described below for accomplishing this result. These control device 50 configurations are advantageous in that they do not require complex, sensitive or unreliable electronics or mechanisms, but are instead relatively simple, economical and reliable in operation.

The well tool 32 may be used in place of any or all of the flow control devices 22*a-e* and actuators 24*a-e* in the system 10 of FIG. 1. Suitably configured, the principles of this disclosure could also be used to control actuation of other well tools, such as selective setting of the packers 18*a-e*, etc.

Note that the hydraulic lines 48*a,b* are representative of one type of fluid pressure source 48 which may be used in keeping with the principles of this disclosure. It should be understood that other fluid pressure sources (such as pressure within the tubing string 20, pressure in an annulus 56 between the tubing and casing strings 20, 16, pressure in an atmospheric or otherwise pressurized chamber, etc., may be used as fluid pressure sources in conjunction with the control device 50 for supplying pressure to the actuator 36 in other embodiments.

The conductors 52*a,b* comprise a set of conductors 52 through which current flows, and this current flow is used by the control device 50 to determine whether the associated well tool 32 is selected for actuation. Two conductors 52*a,b* are depicted in FIG. 2 as being in the set of conductors 52, but it should be understood that any number of conductors may be used in keeping with the principles of this disclosure. In addition, the conductors 52*a,b* can be in a variety of forms, such as wires, metal structures (for example, the casing or tubing strings 16, 20, etc.), or other types of conductors.

The conductors 52*a,b* preferably extend to a remote location (such as the earth's surface, a subsea wellhead, another location in the well, etc.). For example, a surface power supply and multiplexing controller can be connected to the conductors 52*a,b* for flowing current in either direction 54*a,b* between the conductors.

In the examples described below, n conductors can be used to selectively control actuation of n*(n−1) well tools. The benefits of this arrangement quickly escalate as the number of well tools increases. For example, three conductors may be used to selectively actuate six well tools, and only one additional conductor is needed to selectively actuate twelve well tools.

Figure 3:
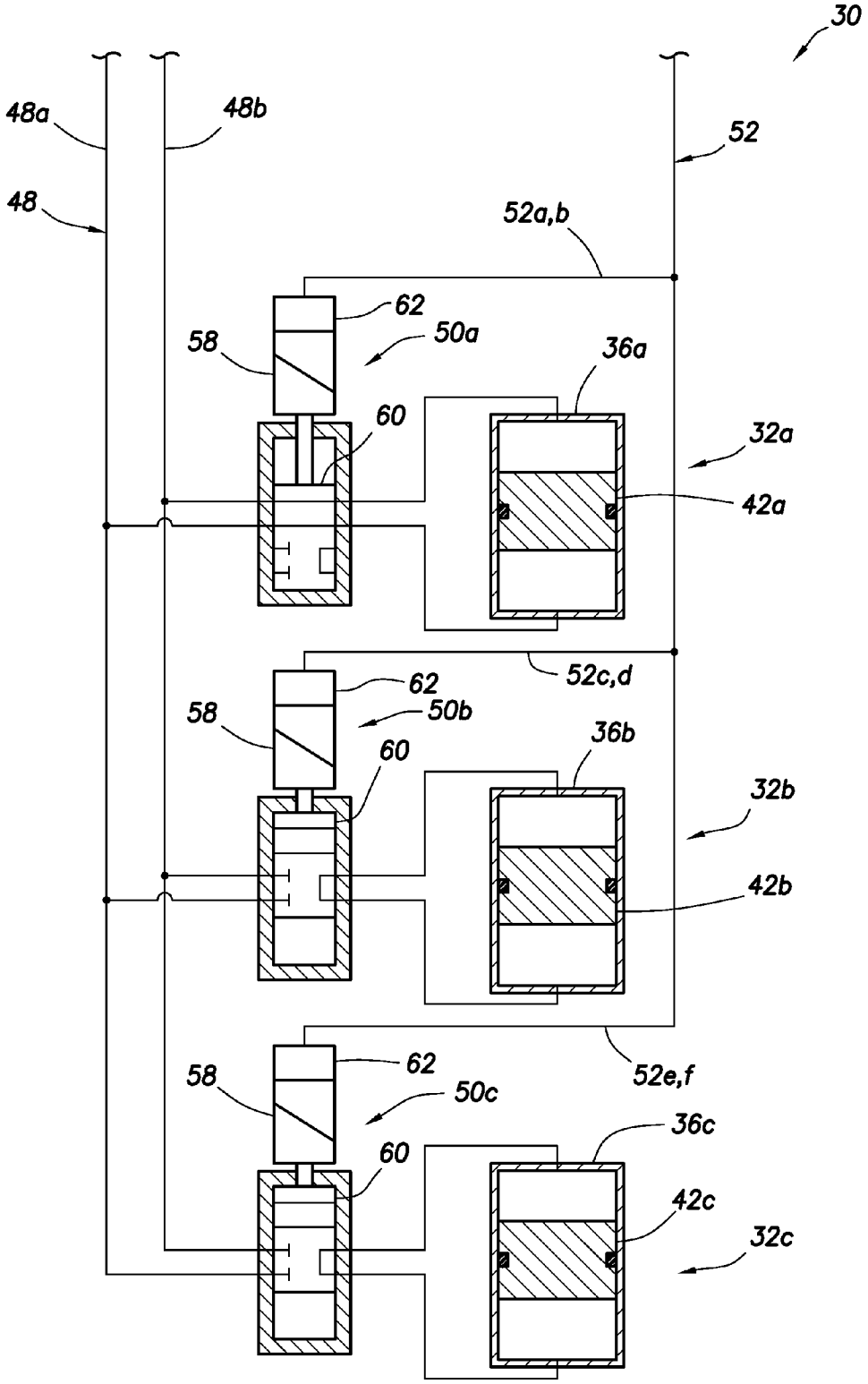
FIG. 3 is a schematic electrical and hydraulic diagram showing a system and method for remotely actuating multiple downhole well tools.

Referring additionally now to FIG. 3, a somewhat more detailed illustration of the electrical and hydraulic aspects of one example of the system 30 are provided. In addition, FIG. 3 provides for additional explanation of how multiple well tools 32 may be selectively actuated using the principles of this disclosure.

In this example, multiple control devices 50*a-c* are associated with respective multiple actuators 36*a-c* of multiple well tools 32*a-c*. It should be understood that any number of control devices, actuators and well tools may be used in keeping with the principles of this disclosure, and that these elements may be combined, if desired (for example, multiple control devices could be combined into a single device, a single well tool can include multiple functional well tools, an actuator and/or control device could be built into a well tool, etc.).

Each of the control devices 50*a-c* depicted in FIG. 3 includes a solenoid actuated spool or poppet valve. A solenoid 58 of the control device 50*a* has displaced a spool or poppet valve 60 to a position in which the actuator 36*a* is now connected to the lines 48*a,b*. A pressure differential between the lines 48*a,b* can now be used to displace the piston 42*a* and actuate the well tool 32*a*. The remaining control devices 50*b,c* prevent actuation of their associated well tools 32*b,c* by isolating the lines 48*a,b* from the actuators 36*b,c*.

The control device 50*a* responds to current flow through a certain set of the conductors 52. In this example, conductors 52*a,b* are connected to the control device 50*a*. When current flows in one direction through the conductors 52*a,b*, the control device 50*a* causes the actuator 36*a* to be operatively connected to the lines 48*a,b*, but when current flows in an opposite direction through the conductors, the control device causes the actuator to be operatively isolated from the lines.

As depicted in FIG. 3, the other control devices 50*b,c* are connected to different sets of the conductors 52. For example, control device 50*b* is connected to conductors 52*c,d* and control device 50*c* is connected to conductors 52*e,f*.

When current flows in one direction through the conductors 52*c,d*, the control device 50*b* causes the actuator 36*b* to be operatively connected to the lines 48*a,b*, but when current flows in an opposite direction through the conductors, the control device causes the actuator to be operatively isolated from the lines. Similarly, when current flows in one direction through the conductors 52*e,f*, the control device 50*c* causes the actuator 36*c* to be operatively connected to the lines 48*a,b*, but when current flows in an opposite direction through the conductors, the control device causes the actuator to be operatively isolated from the lines.

However, it should be understood that multiple control devices are preferably, but not necessarily, connected to each set of conductors. By connecting multiple control devices to the same set of conductors, the advantages of a reduced number of conductors can be obtained, as explained more fully below.

The function of selecting a particular well tool 32*a-c* for actuation in response to current flow in a particular direction between certain conductors is provided by directional elements 62 of the control devices 50*a-c*. Various different types of directional elements 62 are described more fully below.

Figure 4:
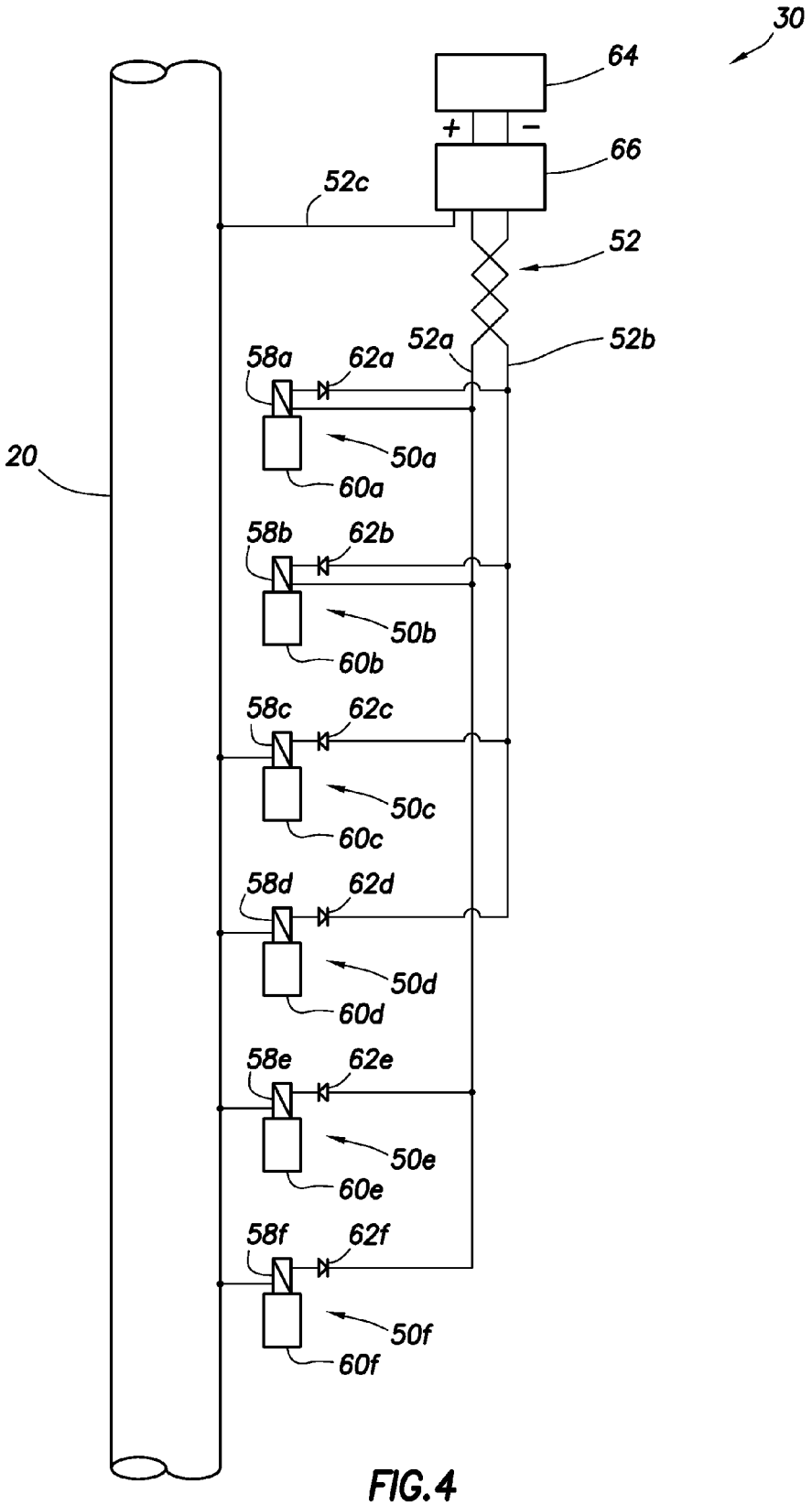
FIG. 4 is a schematic electrical diagram showing another configuration of the system and method for remotely actuating multiple downhole well tools.

Referring additionally now to FIG. 4, an example of the system 30 is representatively illustrated, in which multiple control devices are connected to each of multiple sets of conductors, thereby achieving the desired benefit of a reduced number of conductors in the well. In this example, actuation of six well tools may be selectively controlled using only three conductors, but, as described herein, any number of conductors and well tools may be used in keeping with the principles of this disclosure.

As depicted in FIG. 4, six control devices 50*a-f* are illustrated apart from their respective well tools. However, it will be appreciated that each of these control devices 50*a-f* would in practice be connected between the fluid pressure source 48 and a respective actuator 36 of a respective well tool 32 (for example, as described above and depicted in FIGS. 2 & 3).

The control devices 50*a-f* include respective solenoids 58*a-f*, spool valves 60*a-f* and directional elements 62*a-f*. In this example, the elements 62*a-f* are diodes. Although the solenoids 58*a-f* and diodes 62*a-f* are electrical components, they do not comprise complex or unreliable electronic circuitry, and suitable reliable high temperature solenoids and diodes are readily available.

A power supply 64 is used as a source of direct current. The power supply 64 could also be a source of alternating current and/or command and control signals, if desired. However, the system 30 as depicted in FIG. 4 relies on directional control of current in the conductors 52 in order to selectively actuate the well tools 32, so alternating current, signals, etc. should be present on the conductors only if such would not interfere with this selection function. If the casing string 16 and/or tubing string 20 is used as a conductor in the system 30, then preferably the power supply 64 comprises a floating power supply.

The conductors 52 may also be used for telemetry, for example, to transmit and receive data and commands between the surface and downhole well tools, actuators, sensors, etc. This telemetry can be conveniently transmitted on the same conductors 52 as the electrical power supplied by the power supply 64.

The conductors 52 in this example comprise three conductors 52*a-c*. The conductors 52 are also arranged as three sets of conductors 52*a,b* 52*b,c* and 52*a,c*. Each set of conductors includes two conductors. Note that a set of conductors can share one or more individual conductors with another set of conductors.

Each conductor set is connected to two control devices. Thus, conductor set 52*a,b* is connected to each of control devices 50*a,b*, conductor set 52*b,c* is connected to each of control devices 50*c,d*, and conductor set 52*a,c* is connected to each of control devices 50*e,f*.

In this example, the tubing string 20 is part of the conductor 52*c*. Alternatively, or in addition, the casing string 16 or any other conductor can be used in keeping with the principles of this disclosure.

It will be appreciated from a careful consideration of the system 30 as depicted in FIG. 4 (including an observation of how the diodes 62*a-f* are arranged between the solenoids 58*a-f* and the conductors 52*a-c*) that different current flow directions between different conductors in the different sets of conductors can be used to select which of the solenoids 58*a-f* are powered to thereby actuate a respective well tool. For example, current flow from conductor 52*a* to conductor 52*b* will provide electrical power to solenoid 58*a* via diode 62*a*, but oppositely directed current flow from conductor 52*b* to conductor 52*a* will provide electrical power to solenoid 58*b* via diode 62*b*. Conversely, diode 62*a* will prevent solenoid 58*a* from being powered due to current flow from conductor 52*b* to conductor 52*a*, and diode 62*b* will prevent solenoid 58*b* from being powered due to current flow from conductor 52*a* to conductor 52*b*.

Similarly, current flow from conductor 52*b* to conductor 52*c* will provide electrical power to solenoid 58*c* via diode 62*c*, but oppositely directed current flow from conductor 52*c* to conductor 52*b* will provide electrical power to solenoid 58*d* via diode 62*d*. Diode 62*c* will prevent solenoid 58*c* from being powered due to current flow from conductor 52*c* to conductor 52*b*, and diode 62*d* will prevent solenoid 58*d* from being powered due to current flow from conductor 52*b* to conductor 52*c*.

Current flow from conductor 52*a* to conductor 52*c* will provide electrical power to solenoid 58*e* via diode 62*e*, but oppositely directed current flow from conductor 52*c* to conductor 52*a* will provide electrical power to solenoid 58*f* via diode 62*f*. Diode 62*e* will prevent solenoid 58*e* from being powered due to current flow from conductor 52*c* to conductor 52*a*, and diode 62*f* will prevent solenoid 58*f* from being powered due to current flow from conductor 52*a* to conductor 52*c*.

The direction of current flow between the conductors 52 is controlled by means of a switching device 66. The switching device 66 is interconnected between the power supply 64 and the conductors 52, but the power supply and switching device could be combined, or could be part of an overall control system, if desired.

Figure 5:
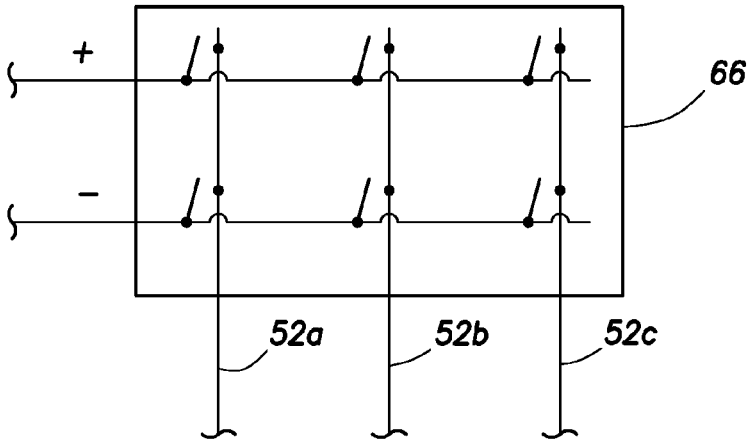
FIG. 5 is a schematic electrical diagram showing details of a switching arrangement which may be used in the system of FIG. 4.
Figure 6:
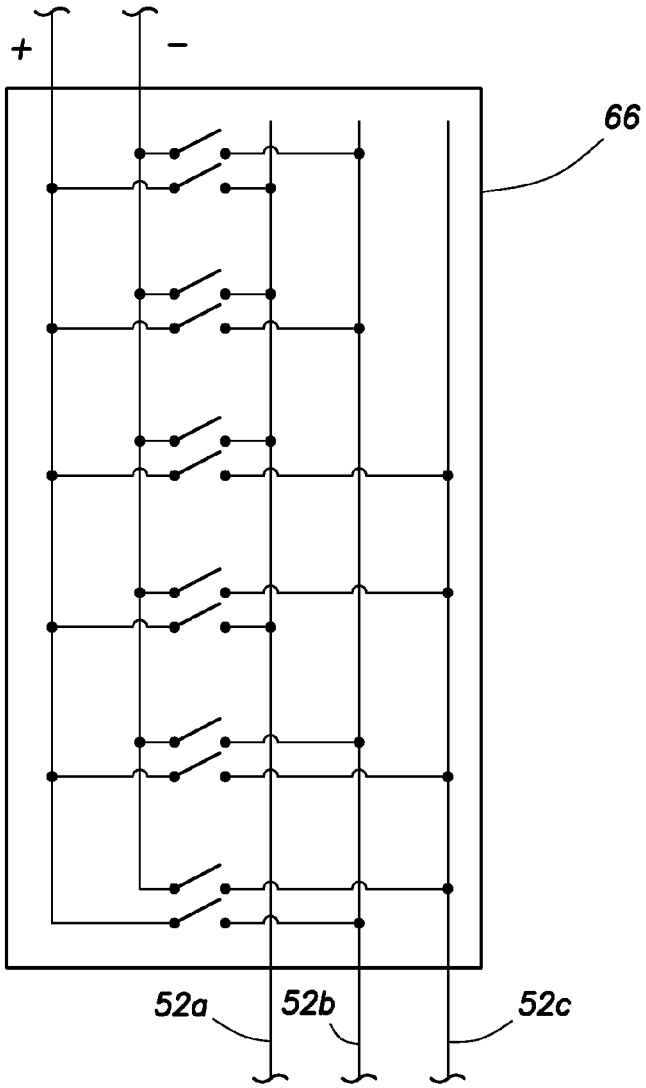
FIG. 6 is a schematic electrical diagram showing details of another switching arrangement which may be used in the system of FIG. 4.

Examples of different configurations of the switching device 66 are representatively illustrated in FIGS. 5 & 6. FIG. 5 depicts an embodiment in which six independently controlled switches are used to connect the conductors 52*a-c* to the two polarities of the power supply 64. FIG. 6 depicts an embodiment in which an appropriate combination of switches are closed to select a corresponding one of the well tools for actuation. This embodiment might be implemented, for example, using a rotary switch. Other implementations (such as using a programmable logic controller, etc.) may be utilized as desired.

Note that multiple well tools 32 may be selected for actuation at the same time. For example, multiple similarly configured control devices 50 could be wired in series or parallel to the same set of the conductors 52, or control devices connected to different sets of conductors could be operated at the same time by flowing current in appropriate directions through the sets of conductors.

In addition, note that fluid pressure to actuate the well tools 32 may be supplied by one of the lines 48, and another one of the lines (or another flow path, such as an interior of the tubing string 20 or the annulus 56) may be used to exhaust fluid from the actuators 36. An appropriately configured and connected spool valve can be used, so that the same one of the lines 48 can be used to supply fluid pressure to displace the pistons 42 of the actuators 36 in each direction.

Preferably, in each of the above-described embodiments, the fluid pressure source 48 is pressurized prior to flowing current through the selected set of conductors 52 to actuate a well tool 32. In this manner, actuation of the well tool 32 immediately follows the initiation of current flow in the set of conductors 52.

Figure 7:
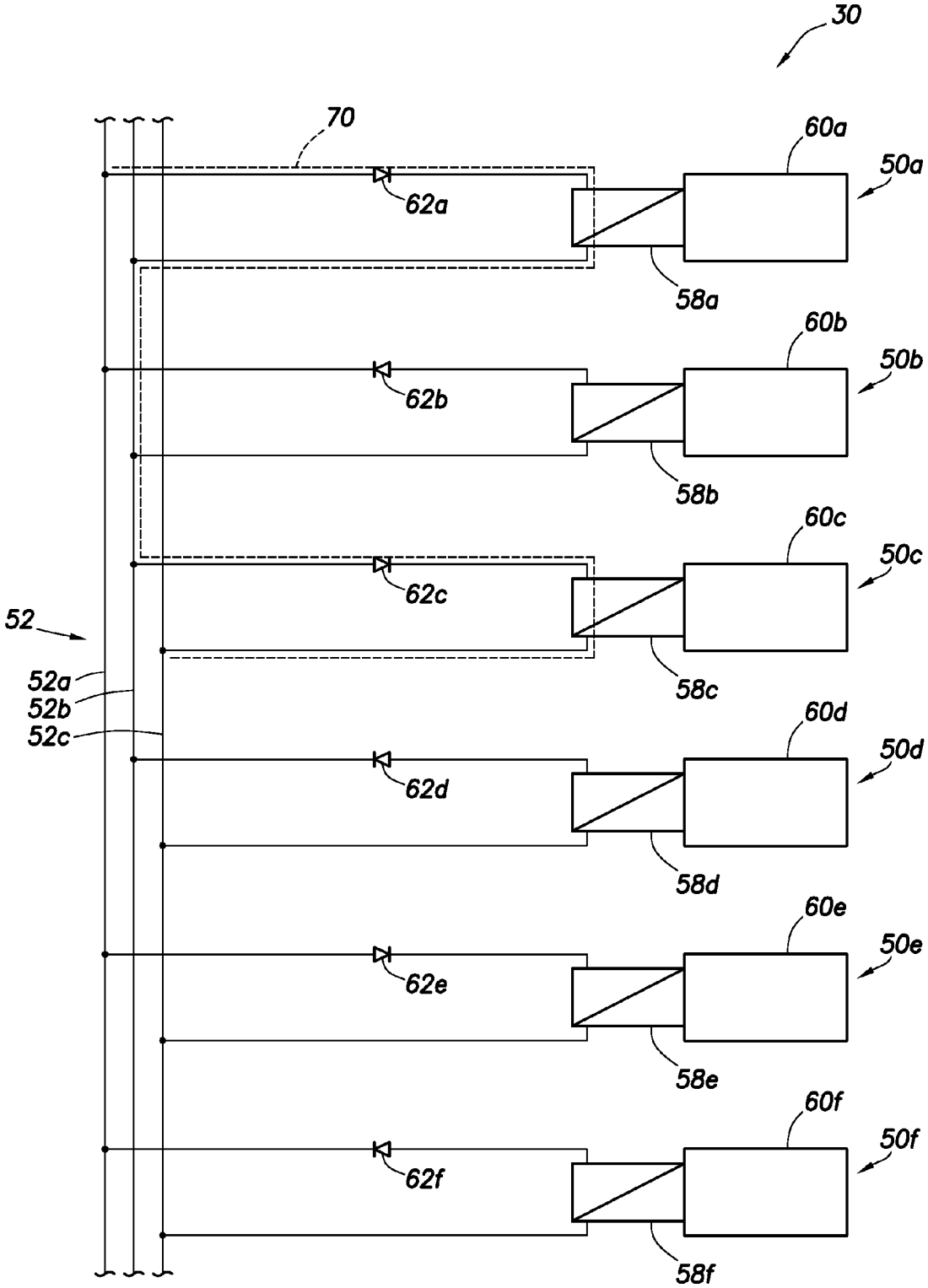
FIG. 7 is a schematic electrical diagram showing the configuration of FIG. 4, in which a current sneak path is indicated.

Referring additionally now to FIG. 7, the system 30 is depicted in a configuration similar in most respects to that of FIG. 4. In FIG. 7, however, a voltage potential is applied across the conductors 52*a*, 52*c* in order to select the control device 50*e* for actuation of its associated well tool 32. Thus, current flows from conductor 52*a*, through the directional element 62*e*, through the solenoid 58*e*, and then to the conductor 52*c*, thereby operating the shuttle valve 60*e*.

However, there is another path for current flow between the conductors 52*a,c*. This current "sneak" path 70 is indicated by a dashed line in FIG. 7. As will be appreciated by those skilled in the art, when a potential is applied across the conductors 52*a,c*, current can also flow through the control devices 50*a,c*, due to their common connection to the conductor 52*b*.

Since the potential in this case is applied across two solenoids 58*a,c* in the sneak path 70, current flow through the control devices 50*a,c* will be only half of the current flow through the control device 50*e* intended for selection, and so the system 30 is still operable to select the control device 50*e* without also selecting the unintended control devices 50*a,c*. However, additional current is flowed through the conductors 52*a,c* in order to compensate for the current lost to the control devices 50*a,c*, and so it is preferred that current not flow through any unintended control devices when an intended control device is selected.

This is accomplished in various examples described below by preventing current flow through each of the control devices 50*a-f* if a voltage potential applied across the control device is less than a minimum level. In each of the examples depicted in FIGS. 8-11 and described more fully below, under-voltage lockout devices 72*a-f* prevent current from flowing through the respective control devices 50*a-f*, unless the voltage applied across the control devices exceeds a minimum.

Figure 8:
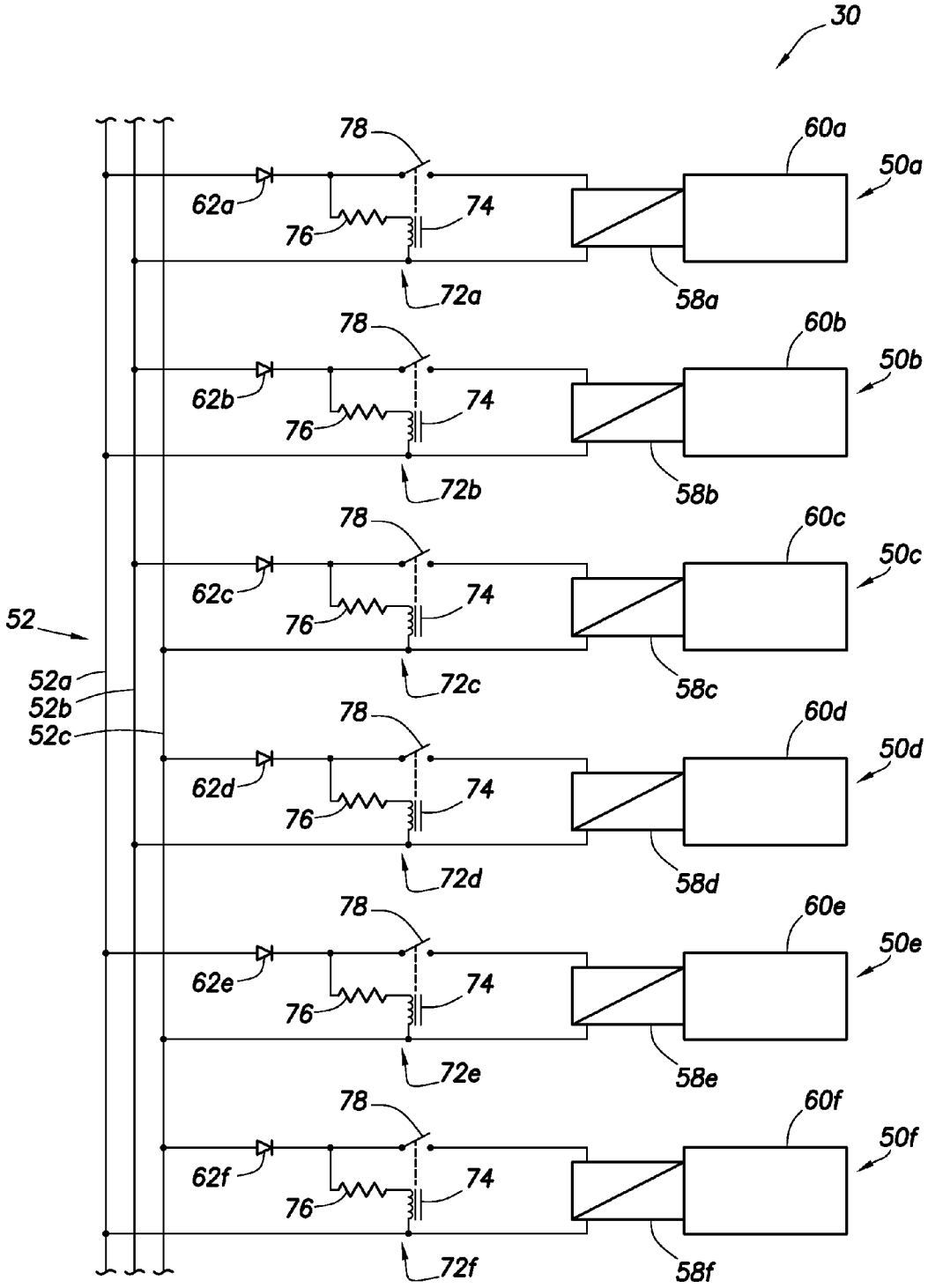
FIG. 8 is a schematic electrical diagram showing details of another configuration of the system and method, in which under-voltage lockout devices prevent current sneak paths in the system.

In FIG. 8, each of the lockout devices 72*a-f* includes a relay 74 and a resistor 76. Each relay 74 includes a switch 78 interconnected between the respective control device 50*a-f* and the conductors 52*a-c*. The resistor 76 is used to set the minimum voltage across the respective conductors 52*a-c* which will cause sufficient current to flow through the associated relay 74 to close the switch 78.

If at least the minimum voltage does not exist across the two of the conductors 52*a-c* to which the control device 50*a-f* is connected, the switch 78 will not close. Thus, current will not flow through the associated solenoid 58*a-f*, and the respective one of the control devices 50*a-f* will not be selected.

As in the example of FIG. 7, sufficient voltage would not exist across the two conductors to which each of the lockout devices 72*a,c* is connected to operate the relays 74 therein if a voltage is applied across the conductors 52*a,c* in order to select the control device 50*e*. However, sufficient voltage would exist across the conductors 52*a,c* to cause the relay 74 of the lockout device 72*e* to close the switch 78 therein, thereby selecting the control device 50*e* for actuation of its associated well tool 32.

Figure 9:
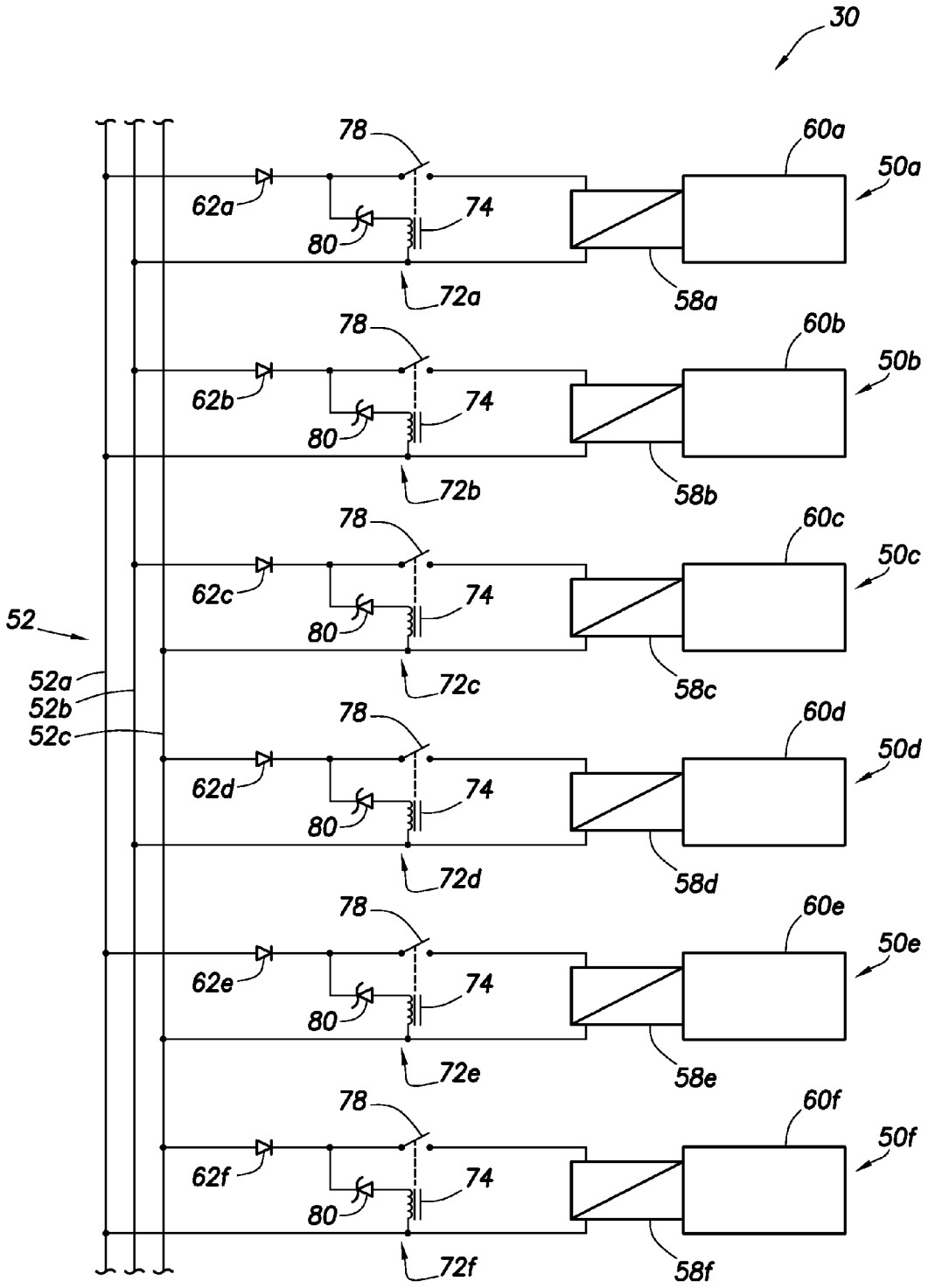
FIG. 9 is a schematic electrical diagram showing details of another configuration of the system and method, in which another configuration of under-voltage lockout devices prevent current sneak paths in the system.

In FIG. 9, the lockout devices 72*a-f* each include the relay 74 and switch 78, but the resistor is replaced by a zener diode 80. Unless a sufficient voltage exists across each zener diode 80, current will not flow through its associated relay 74, and the switch 78 will not close. Thus, a minimum voltage must be applied across the two of the conductors 52*a-c* to which the respective one of the control devices 50*a-f* is connected, in order to close the associated switch 78 of the respective lockout device 72*a-f* and thereby select the control device.

Figure 10:
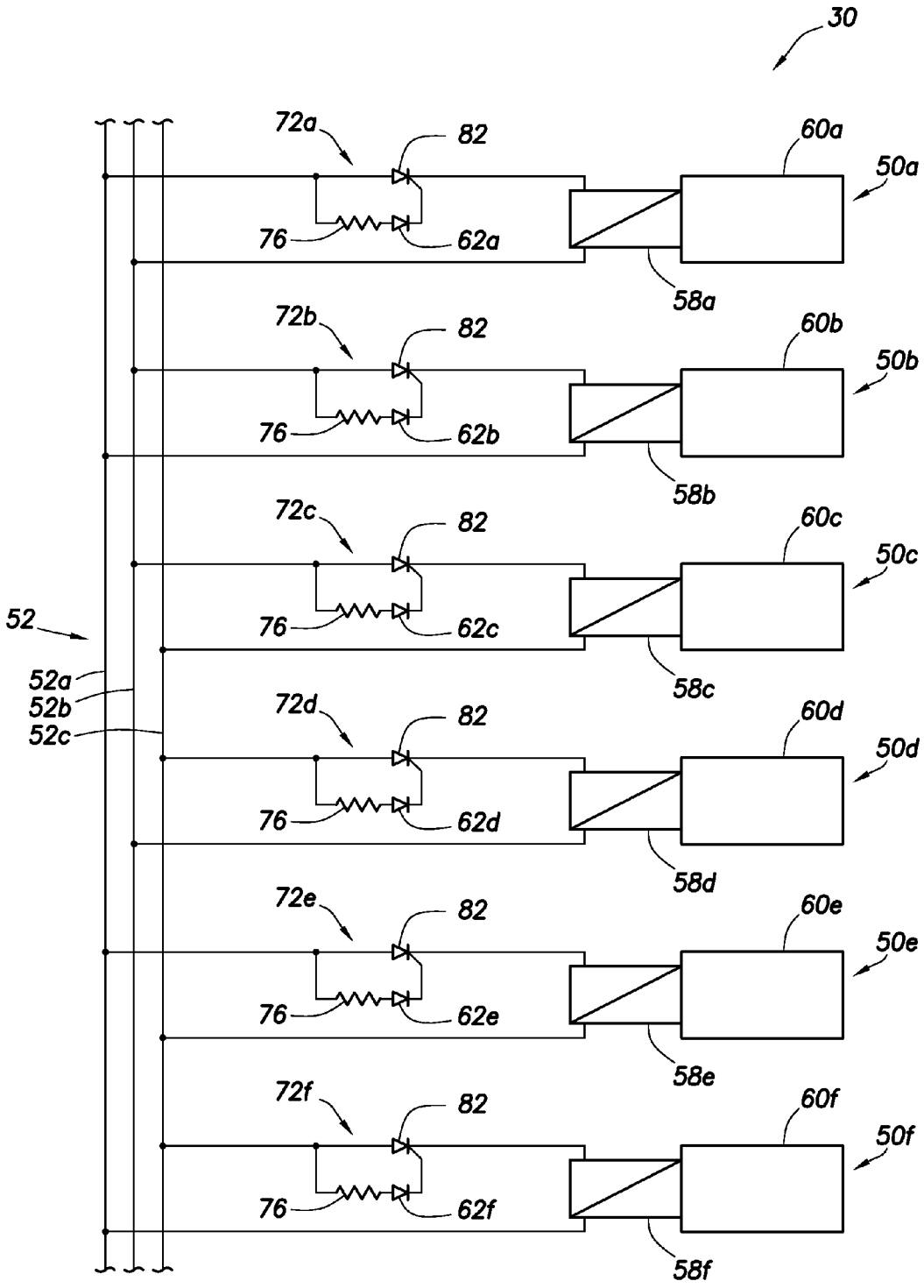
FIG. 10 is a schematic electrical diagram showing details of another configuration of the system and method, in which yet another configuration of under-voltage lockout devices prevent current sneak paths in the system.

In FIG. 10, a thyristor 82 (specifically in this example a silicon controlled rectifier) is used instead of the relay 74 in each of the lockout devices 72*a-f*. Other types of thyristors and other gating circuit devices (such as TRIAC, GTO, IGCT, SIT/SITh, DB-GTO, MCT, CSMT, RCT, BRT, etc.) may be used, if desired. Unless a sufficient voltage exists across the source and gate of the thyristor 82, current will not flow to its drain. Thus, a minimum voltage must be applied across the two of the conductors 52*a-c* to which the respective one of the control devices 50*a-f* is connected, in order to cause current flow through the thyristor 82 of the respective lockout device 72*a-f* and thereby select the control device. The thyristor 82 will continue to allow current flow from its source to its drain, as long as the current remains above a predetermined level.

Figure 11:
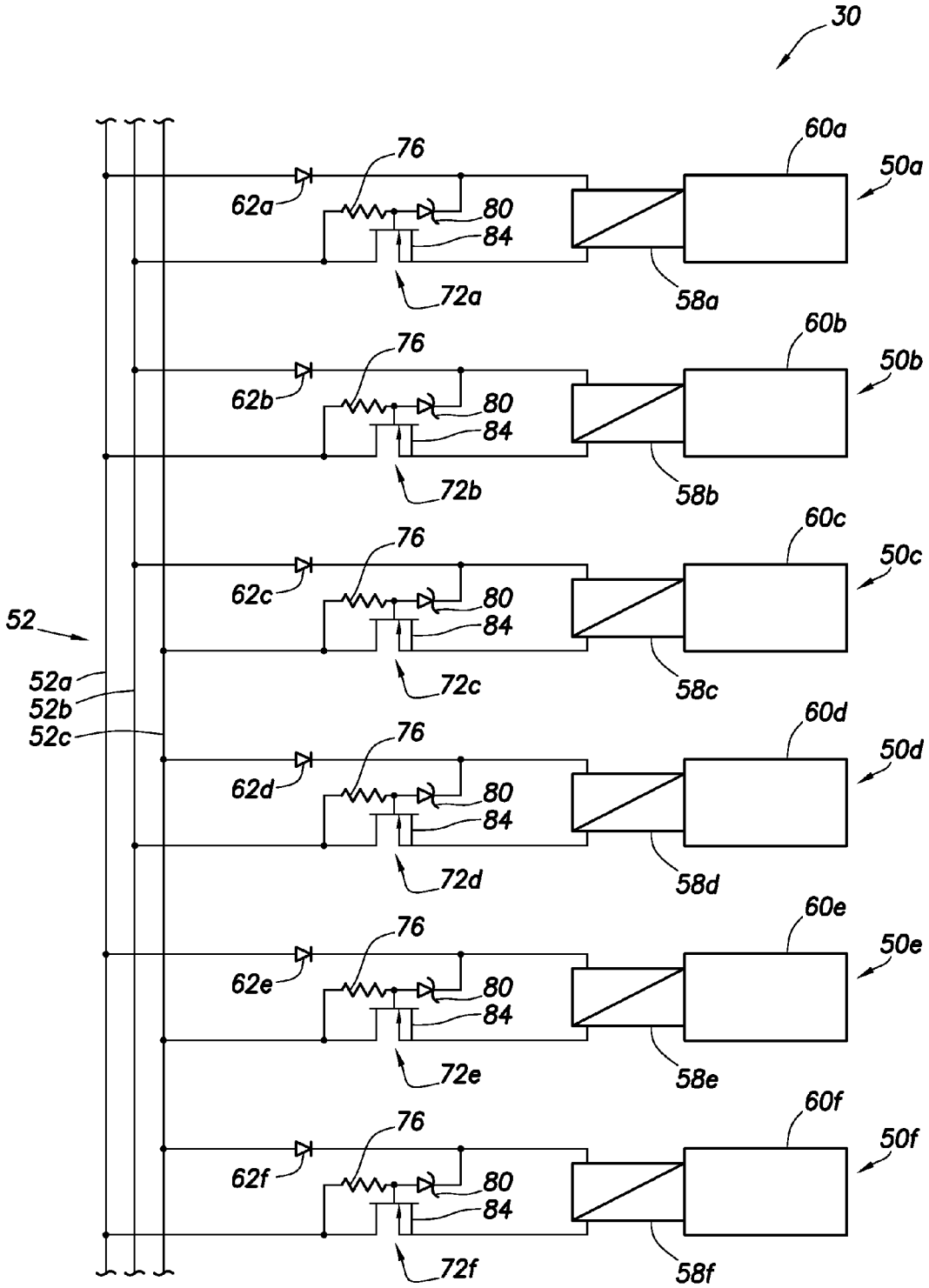
FIG. 11 is a schematic electrical diagram showing details of another configuration of the system and method, in which a further configuration of under-voltage lockout devices prevent current sneak paths in the system.

In FIG. 11, a field effect transistor 84 (specifically in this example an n-channel MOSFET) is interconnected between the control device 50*a-f* and one of the associated conductors 52*a-c* in each of the lockout devices 72*a-f*. Unless a voltage exists across the gate and drain of the transistor 84, current will not flow from its source to its drain. The voltage does not exist unless a sufficient voltage exists across the zener diode 80 to cause current flow through the diode. Thus, a minimum voltage must be applied across the two of the conductors 52*a-c* to which the respective one of the control devices 50*a-f* is connected, in order to cause current flow through the transistor 84 of the respective lockout device 72*a-f* and thereby select the control device.

It may now be fully appreciated that the above disclosure provides several improvements to the art of selectively actuating downhole well tools. One such improvement is the elimination of unnecessary current draw by control devices which are not intended to be selected for actuation of their respective well tools.

The above disclosure provides a system 30 for selectively actuating from a remote location multiple downhole well tools 32 in a well. The system 30 includes at least one control device 50*a-f* for each of the well tools 32, such that a particular one of the well tools 32 can be actuated when a respective control device 50*a-f* is selected. Conductors 52 are connected to the control devices 50*a-f*, whereby each of the control devices 50*a-f* can be selected by applying a predetermined voltage potential across a respective predetermined pair of the conductors 52. At least one lockout device 72*a-f* is provided for each of the control devices 50*a-f*, whereby the lockout devices 72*a-f* prevent current from flowing through the respective control devices 50*a-f* if the voltage potential across the respective predetermined pair of the conductors 52 is less than a predetermined minimum.

Each of the lockout devices 72*a-f* may include a relay 74 with a switch 78. The relay 74 closes the switch 78, thereby permitting current flow through the respective control device 50*a-f* when the predetermined minimum voltage potential is applied across the lockout device 72*a-f*.

Each of the lockout devices 72*a-f* may include a thyristor 82. The thyristor 82 permits current flow from its source to is drain, thereby permitting current flow through the respective control device 50*a-f* when the predetermined minimum voltage potential is applied across the lockout device 72*a-f*.

Each of the lockout devices 72*a-f* may include a zener diode 80. Current flows through the zener diode 80, thereby permitting current flow through the respective control device 50*a-f* when the predetermined minimum voltage potential is applied across the lockout device 72*a-f*.

Each of the lockout devices 72*a-f* may include a transistor 84. The transistor 84 permits current flow from its source to is drain, thereby permitting current flow through the respective control device 50*a-f* when the predetermined minimum voltage potential is applied across the lockout device 72*a-f*.

Also described above is a method of selectively actuating from a remote location multiple downhole well tools 32 in a well. The method includes the steps of: selecting a first one of the well tools 32 for actuation by applying a predetermined minimum voltage potential to a first set of conductors 52*a,c* in the well; and preventing actuation of a second one of the well tools 32 when the predetermined minimum voltage potential is not applied across a second set of conductors in the well 52*a,b* or 52*b,c*. At least one of the first set of conductors 52*a,c* is the same as at least one of the second set of conductors 52*a,b* or 52*b,c*.

The selecting step may include permitting current flow through a control device 50*a-f* of the first well tool in response to the predetermined minimum voltage potential being applied across a lockout device 72*a-f* interconnected between the control device 50*a-f* and the first set of conductors 52*a,c*.

The current flow permitting step may include actuating a relay 74 of the lockout device 72*a-f* to thereby close a switch 78, thereby permitting current flow through the control device 50*a-f* when the predetermined minimum voltage potential is applied across the lockout device 72*a-f*.

The current flow permitting step may include permitting current flow from a source to a drain of a thyristor 82 of the lockout device 72*a-f*, thereby permitting current flow through the control device 50*a-f* when the predetermined minimum voltage potential is applied across the lockout device 72*a-f*.

The current flow permitting step may include permitting current flow through a zener diode 80 of the lockout device 72*a-f*, thereby permitting current flow through the control device 50*a-f* when the predetermined minimum voltage potential is applied across the lockout device 72*a-f*.

The current flow permitting step may include permitting current flow from a source to a drain of a transistor 84 of the lockout device 72*a-f*, thereby permitting current flow through the control device 50*a-f* when the predetermined minimum voltage potential is applied across the lockout device 72*a-f*.

The above disclosure also describes a system 30 for selectively actuating from a remote location multiple downhole well tools 32 in a well, in which the system 30 includes: at least one control device 50*a-f* for each of the well tools 32, such that a particular one of the well tools 32 can be actuated when a respective control device 50*a-f* is selected; conductors 52 connected to the control devices 50*a-f*, whereby each of the control devices 50*a-f* can be selected by applying a predetermined voltage potential across a respective predetermined pair of the conductors 52; and at least one lockout device 72*a-f* for each of the control devices 50*a-f*, whereby each lockout device 72*a-f* prevents a respective control device 50*a-f* from being selected if the voltage potential across the respective predetermined pair of the conductors 52 is less than a predetermined minimum.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A system for selectively actuating from a remote location multiple downhole well tools in a well, the system comprising:

first, second, and third conductors;

a first control device which controls actuation of a first well tool, wherein the first control device is connected between the first and second conductors, and wherein the first control device is not electrically connected to the third conductor;

a second control device which controls actuation of a second well tool, wherein the second control device is connected between the first and third conductors, and wherein the second control device is not electrically connected to the second conductor, whereby a respective one of the first and second control devices is selected by applying at least a predetermined minimum voltage potential across a respective pair of the conductors; and first and second lockout devices, whereby current is prevented from flowing through the second control device when the first control device is selected, and whereby current is prevented from flowing through the first control device when the second control device is selected.

2. The system of claim 1, wherein at least one of the lockout devices includes a relay with a switch, and wherein the relay closes the switch, thereby permitting current flow through the selected control device when the predetermined minimum voltage potential is applied across the respective pair of the conductors.

3. The system of claim 1, wherein at least one of the lockout devices includes a thyristor, and wherein the thyristor permits current flow from a source to a drain of the thyristor, thereby permitting current flow through the selected control device when the predetermined minimum voltage potential is applied across the respective pair of the conductors.

4. The system of claim 1, wherein at least one of the lockout devices includes a zener diode, and wherein current flows through the zener diode, thereby permitting current flow through the selected control device when the predetermined minimum voltage potential is applied across the respective pair of the conductors.

5. The system of claim 1, wherein at least one of the lockout devices includes a transistor, and wherein the transistor permits current flow from a source to a drain of the transistor, thereby permitting current flow through the selected control device when the predetermined minimum voltage potential is applied across the respective pair of the conductors.

6. The system of claim 1, wherein at least one of the lockout devices includes a relay with a switch, and wherein the switch remains open unless the predetermined minimum voltage potential is applied across the respective pair of the conductors.

7. The system of claim 1, wherein at least one of the lockout devices includes a thyristor, and wherein current is prevented from flowing unless the predetermined minimum voltage potential is applied across the respective pair of the conductors.

8. The system of claim 1, wherein at least one of the lockout devices includes a zener diode, and wherein current is prevented from flowing unless the predetermined minimum voltage potential is applied across the respective pair of the conductors.

9. The system of claim 1, wherein at least one of the lockout devices includes a transistor, and wherein current is prevented from flowing unless the predetermined minimum voltage potential is applied across the respective pair of the conductors.

10. A method of selectively actuating from a remote location multiple downhole well tools in a well, the method comprising the steps of:

connecting a first control device of a first well tool between first and second conductors, wherein the first well tool is selected for actuation via the first and second conductors;

connecting a second control device of a second well tool between the first conductor and a third conductor, wherein the second well tool is selected for actuation via the first and third conductors;

selecting a respective one of the first and second well tools for actuation by applying at least a predetermined minimum voltage potential across a respective pair of the conductors; and providing first and second lockout devices, thereby fully preventing current flow through the first control device of the first well tool when the second well tool is selected for actuation, and thereby fully preventing current flow through the second control device of the second well tool when the first well tool is selected for actuation.

11. The method of claim 10, wherein the selecting step further comprises permitting current flow through the respective control device of the selected well tool when the predetermined minimum voltage potential is applied across the respective pair of the conductors.

12. The method of claim 11, wherein the current flow permitting step further comprises actuating a relay to thereby close a switch, thereby permitting current flow through the respective control device when the predetermined minimum voltage potential is applied across the respective pair of the conductors.

13. The method of claim 11, wherein the current flow permitting step further comprises permitting current flow from a source to a drain of a thyristor, thereby permitting current flow through the respective control device when the predetermined minimum voltage potential is applied across the respective pair of the conductors.

14. The method of claim 11, wherein the current flow permitting step further comprises permitting current flow through a zener diode, thereby permitting current flow through the respective control device when the predetermined minimum voltage potential is applied across the respective pair of the conductors.

15. The method of claim 11, wherein the current flow permitting step further comprises permitting current flow from a source to a drain of a transistor, thereby permitting current flow through the respective control device when the predetermined minimum voltage potential is applied across the respective pair of the conductors.

* * * * *